United States Patent [19]

Hirai

[11] Patent Number: 4,767,071

[45] Date of Patent: Aug. 30, 1988

[54] METHOD OF WINDING YARN AND DEVICE FOR CARRYING OUT THE SAME

[75] Inventor: Kazuyasu Hirai, Nagaokakyo, Japan

[73] Assignee: Murata Kikai Kabushiki Kaisha, Kiyoto, Japan

[21] Appl. No.: 124,342

[22] Filed: Nov. 20, 1987

Related U.S. Application Data

[63] Continuation of Ser. No. 808,557, Dec. 13, 1985, abandoned.

[30] Foreign Application Priority Data

Dec. 19, 1984 [JP] Japan ..... 59-267740

[51] Int. Cl.[4] ..... B65H 54/38; B65H 54/32

[52] U.S. Cl. ..... 242/18.1; 242/43 R; 242/43.1

[58] Field of Search ..... 242/18.1, 43 R, 43.1

[56] References Cited

U.S. PATENT DOCUMENTS 3,690,579 9/1972 Porter ..... 242/18.1 X
4,544,113 10/1985 Yoshinaga et al. ..... 242/43 R X
4,555,069 11/1985 Maeda et al. ..... 242/18.1

*Primary Examiner*—Stanley N. Gilreath
*Attorney, Agent, or Firm*—Barnes, Kisselle, Raisch, Choate, Whittemore & Hulbert

[57] ABSTRACT

A yarn is traversed by a drum provided with a guide groove having a plurality of the above-mentioned traversing grooves so that the returning positions at the opposite ends of the package are varied alternately in the direction of the axis of the drum, and the outer returning positions and the inner returning positions are made to creep differently. The creeping is achieved by controlling the traverse guide which travels along the guide groove with a cam.

11 Claims, 10 Drawing Sheets

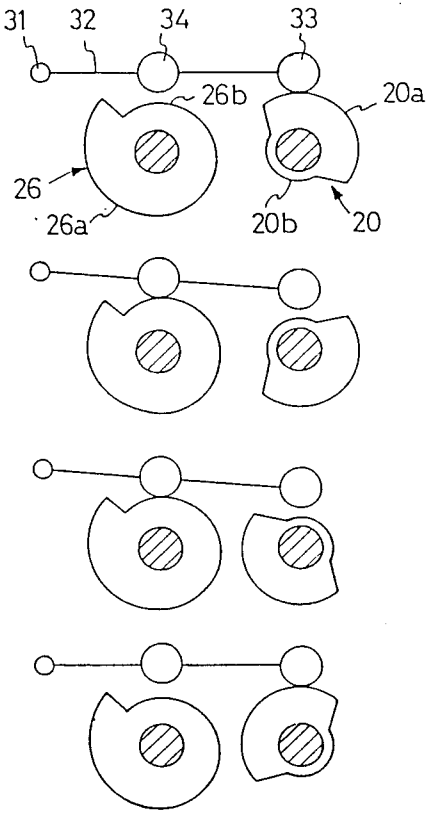
FIG. 8a
FIG. 8b
FIG. 8c
FIG. 8d
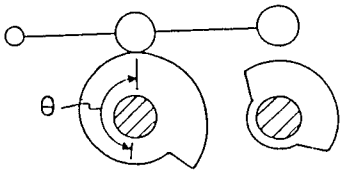
FIG. 8e
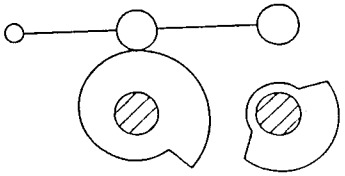
FIG. 8f
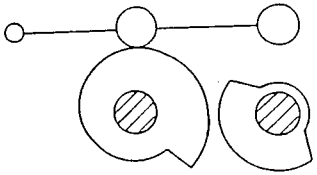
FIG. 8g
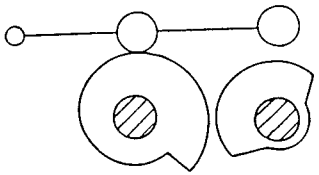
FIG. 8h FIG. 11a
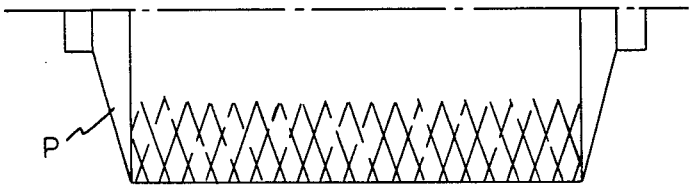
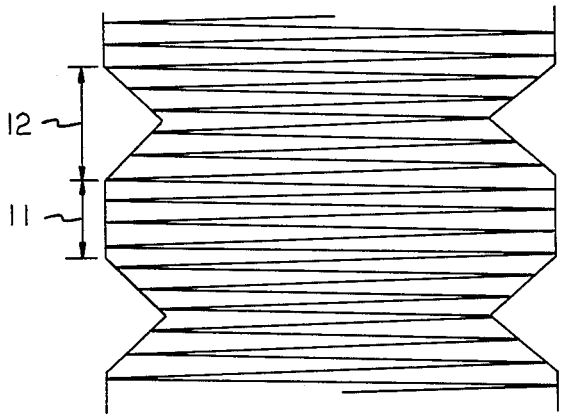
FIG. 11b

METHOD OF WINDING YARN AND DEVICE FOR CARRYING OUT THE SAME

This application is a continuation of application Ser. No. 808,557, filed Dec. 13, 1985, now abandoned.

FIELD OF THE INVENTION AND RELATED ART STATEMENT

The present invention relates to a method of winding a yarn on a rotating bobbin in various textile machines and a device for carrying out the method.

Reference is made to a U.S. Pat. No. 4,555,069 to Maeda, issued Nov. 26, 1985.

On a textile machine, such as a false twister, spinning machine or a winder, a yarn is wound continuously on a continuously rotating bobbin while the yarn is traversed along the axis of the bobbin. The traverse motion incorporates a motion generally designated as creeping or edge control to prevent the protuberance of the opposite ends of a package, which is generally designated as edge rising.

Creeping is the periodic or aperiodic variation of the returning position of a yarn being traversed at the opposite ends of a package. Creeping reduces the amount of yarn wound in the opposite ends of the package relative to the amount of yarn wound in other portions of the package, and thereby the edge rising is prevented.

Ribboning over the circumference of a package is another problem in winding a yarn. Ribboning occurs when a certain length of a yarn is wound in a parallel and adjacent arrangement. The adjacent portions of the yarn are intertwined with each other, which makes unwinding the yarn from the package difficult. The applicant of the present invention proposes means for avoiding ribboning, in which a traverse guide, i.e., a yarn guide, is traversed by a drum provided in the outer circumference thereof with a guide groove consisting of two sets of traversing grooves as it will be mentioned hereinafter. Since the traversing grooves are different from each other, the drum is able to reduce ribboning and to improve edge rising in the package. However, small protuberances are formed at each axial end of the package at positions corresponding to the returning positions.

OBJECT AND SUMMARY OF THE INVENTION

It is an object of the present invention to provide a method of winding a yarn and a device for carrying out the same, capable of eliminating both edge rising and ribboning.

According to the present invention, a yarn is traversed by a drum provided with a guide groove having a plurality of the above-mentioned traversing grooves so that the returning positions at the opposite ends of the package are varied alternately in the direction of the axis of the drum, and the outer returning positions and the inner returning positions are made to creep differently. The creeping is achieved by controlling the traverse guide which travels along the guide groove with a cam. Furthermore, means for disconnecting the cam and the traverse guide at returning positions on one end of the drum is provided to interrupt the creeping motion temporarily.

According to the present invention, the yarn is subjected to a creeping action at either the outer returning position or the inner returning position, and the yarn is released from a creeping action at the other returning position. Accordingly, the loci of the above-mentioned returning positions are different from each other and the respective shapes of the opposite ends of the package is decided by the combined effect of the different loci.

BRIEF DESCRIPTION OF THE DRAWINGS

FIGS. 8*a* to 8*h* are diagrammatic illustrations of assistance in explaining the actions of a synchronizing cam and the creeping cam;

FIGS. 11*a* and 11*b* are diagrammatic views respectively showing the shape of a package and the traverse of the yarn in a conventional winding method.

DETAILED DESCRIPTION OF PREFERRED EMBODIMENTS

Figure 1A:
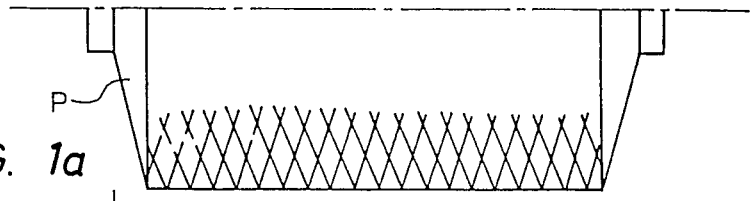
FIGS. 1*a* to 1*c* are diagrammatic views showing a package formed according to the present invention and the manner of traversing a yarn according to the present invention.

In the following specification reference is made to "returning positions". A return position at one end of a drum or bobbin winding is that point at which the winding traverse moving toward one end of a winding reverses and starts back toward the other end. A "right returning position" has reference to the drawings in which the return position is at the right end of the drum or bobbin. A "left returning position" is at the left end of the drum or bobbin as viewed in the drawings.

The "return positions" also vary in the distance from the end of a winding bobbin, some being at the outer end and others being spaced axially from the end to inner positions.

With respect to a cam drum, a "progressing groove" moves a yarn guide follower from left to right as viewed in the drawings and a "returning groove" moves a yarn guide follower from right to left.

Creeping is illustrated in FIGS. 11*a* and 11*b*.

The yarn amount reducing ratio for the opposite ends of the package P is proportional to a ratio: $t_2/(t_1+t_2)$, where $t_1$ is a time interval in which the stroke of traverse is the maximum stroke and $t_2$ is a time interval in which the stroke of traverse is less than the maximum stroke. The ratio: $t_2/(t_1+t_2)$ is decided appropriately to form a package having a satisfactory shape and not having any protuberant edge.

Figure 12:
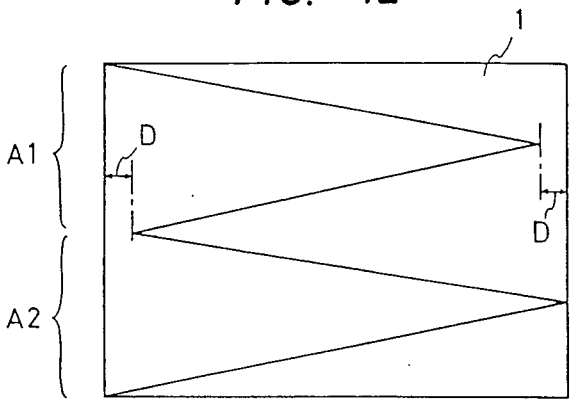
FIG. 12 is a diagrammatic view of assistance in explaining the configuration of a drum having a guide groove consisting of two sets of traversing grooves.

For avoiding ribboning, a drum 1 is provided with a guide groove consisting of two sets of traversing grooves $A_1$ and $A_2$ as illustrated in FIG. 12.

Figure 13A:
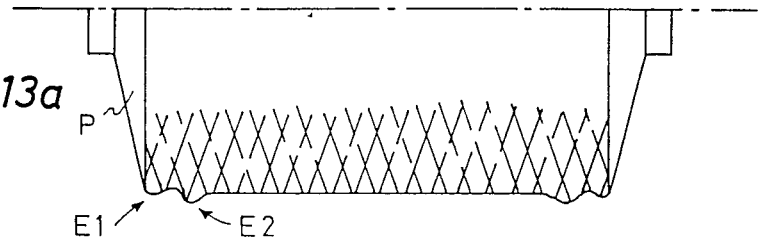
FIGS. 13*a* and 13*b* are diagrammatic views showing the shape of a package and the traverse of the yarn obtained by the drum of FIG. 12.
Figure 13B:
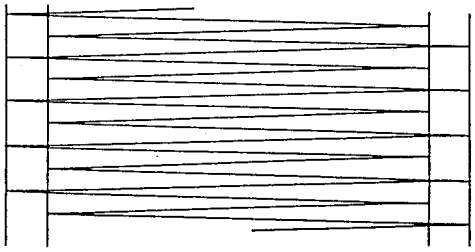

In this drum 1, one of the two returning positions at each end of the drum 1 is displaced along the axis of the drum 1 from the other by a distance D. This drum 1 traverses a yarn as illustrated in FIG. 13*b*. Since the traversing grooves $A_1$ and $A_2$ are different from each other, the drum 1 is able to reduce ribboning and to improve edge rising in the package P. However, as illustrated in FIG. 13*a*, two small protuberances $E_1$ and $E_2$ are formed still at each axial end of the package P at positions corresponding to the returning positions.

Figure 14A:
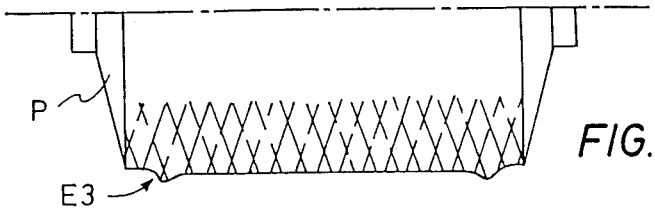
FIG. 14*a* to 14*c* are diagrammatic views showing the shape of a package and the traverse of the yarn obtained by the use of the drum of FIG. 12 assisted by the creeping motion.
Figure 14B:
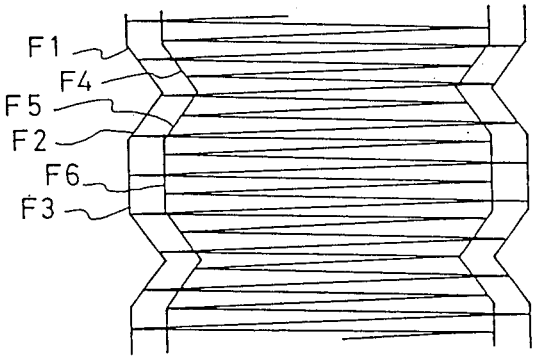
Figure 14C:
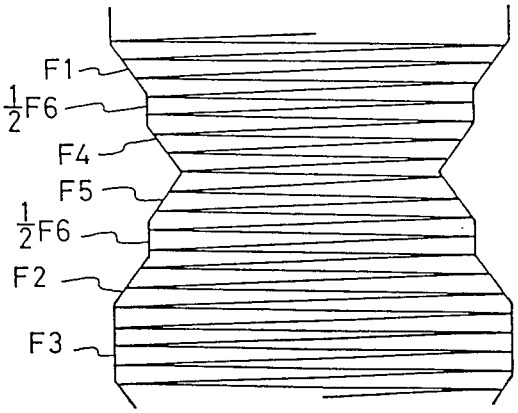

To solve the above-mentioned problem, the inventors of the present invention carried out trial yarn winding in the manner as shown in FIG. 14*b* by using the drum 1 having the traversing grooves $A_1$ and $A_2$ and incorporating a creeping motion. FIG. 14*b* illustrates the actual traverse motion of the yarn. The package P thus formed no longer had the outer protuberances $E_1$ and $E_2$; however, small inner protuberances $E_3$ were formed still at positions corresponding to the inner returning positions as illustrated in FIG. 14*a*. FIG. 14*c* illustrates tracks of the traverse guide in a rearranged order, estimated on an assumption that the traverse guide was traversed by a conventional drum having only one traversing groove. Specifically, the segments $F_1$ to $F_6$ in one cycle of the respective loci of the outer and inner returning positions are rearranged in the order of segments $F_1$, $F_6/2$, $F_4$, $F_5$, $F_6/2$, $F_2$ and $F_3$. As apparent from FIG. 14*c*, in the segments $F_6/2$, the returning positions are unvaried temporarily, and thereby the protuberances $E_3$ are formed.

An embodiment of the present invention will be described as follows.

Figure 2:
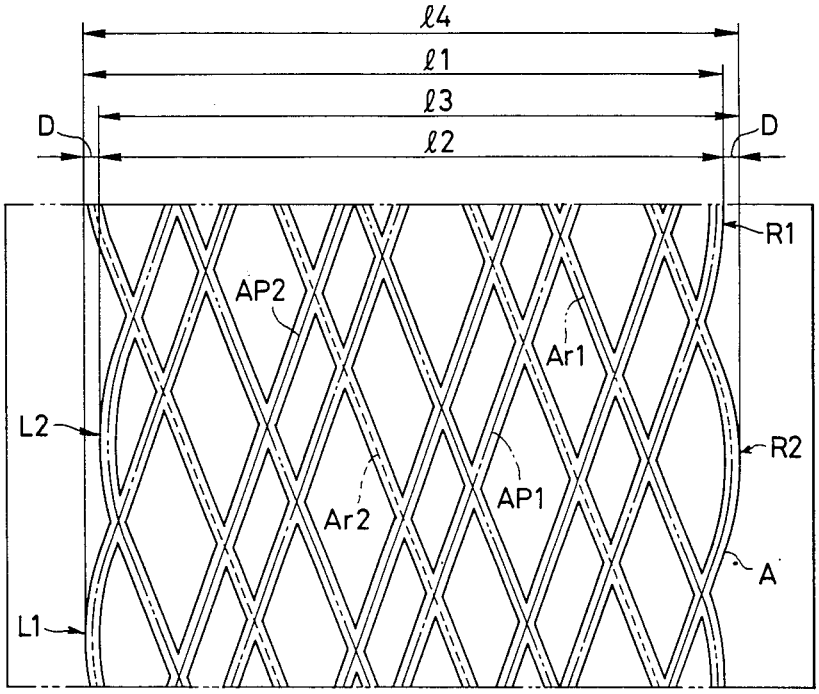
FIG. 2 is a view showing the development of a drum employed in the embodiments of the present invention.
Figure 3:
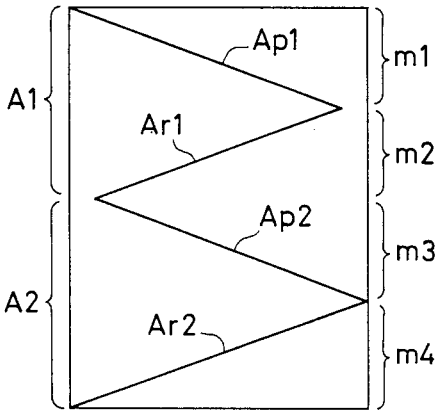
FIG. 3 is a diagrammatic view of assistance in explaining the general configuration of the drum of FIG. 2.

FIG. 2 is a development of a drum. In FIG. 2, a guide groove A indicated by thick continuous lines consists of a first progressing groove Ap1 extending from a first left returning position L1 to a first right returning position R1 and indicated by alternate long and short dash lines, a first returning groove Ar1 extending from the first right returning position R1 to a second left returning position L2 and indicated by alternate long and two short dashes lines, a second progressing groove Ap2 extending from the second returning position L2 to a second right returning position R2 and indicated by thin continuous lines, and a second returning groove Ar2 extending from the second right returning position R2 to the first left returning position L1 and indicated by broken lines. The first progressing groove Ap1, the first returning groove Ar1, the second progressing groove Ap2 and the second returning groove Ar2 are connected sequentially to constitute the endless guide groove A. The first progressing groove Ap1 and the first returning groove Ar1 constitute a first traversing groove A1, while the second progressing groove Ap2 and the second returning groove Ar2 constitute a second traversing groove A2. On the drum 1, the distance between the first left returning position L1 and the first right returning position R1 along the axis of the drum 1, namely, the axial length of the first progressing groove Ap1 is 11, the axial length of the first returning groove Ar1 is 12, the axial length of the second progressing groove Ap2 is 13 and the axial length of the second returning groove Ar2 is 14. The lengths l1, l2, l3 and l4 are different from each other except l1=l3. The axial distances between the first left returning position L1 and the second left returning position L2 and between the first right returning position R1 and the second right returning position R2 are the same value D. The drum 1 needs to be turned by m1 turns, m2 turns, m3 turns and m4 turns to move the traverse guide from one end to the other of the first progressing groove Ap1, the first returning groove Ar1, the second progressing groove Ap2 and the second returning groove Ar2, respectively. When this number of turns is designated as wind number, the wind number of the first traversing groove A1 is m1 +m2, while the wind number of the second traverse groove A2 is m3+m4. The wind numbers are decided so that the wind numbers m1+m2 and m3+m4 are different from each other. In this embodiment, the wind numbers are, for example, m1=m3=3.75, m2=3.65 and m4=3.85.

Figure 4:
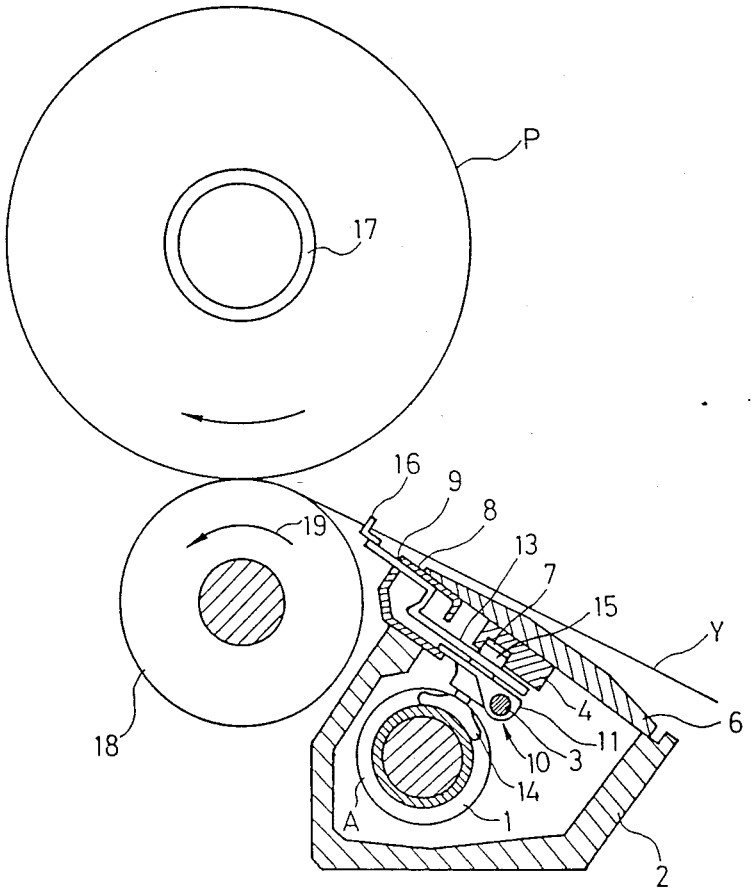
FIG. 4 is a sectional view of a traverse motion mechanism.
Figure 5:
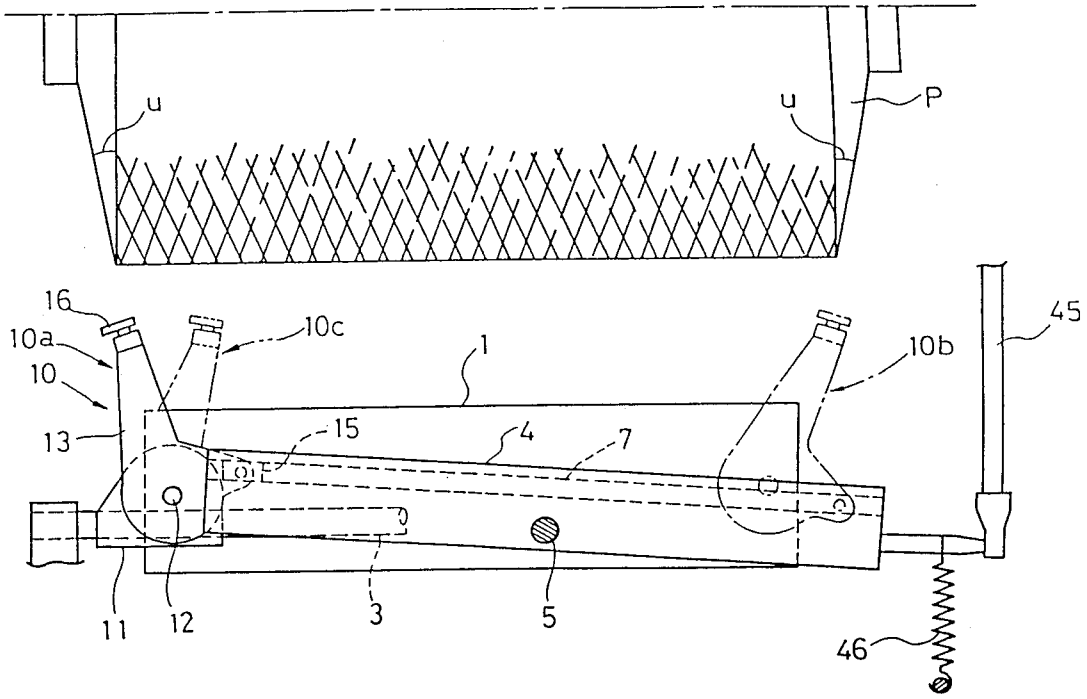
FIG. 5 is a plan view of the traverse motion of FIG. 4.

FIGS. 4 and 5 illustrate a traverse device. The cylindrical drum 1 is disposed within a cam box 2. A guide rod 3 is extended within the cam box 2 in parallel to the axis of the drum 1. A cam plate 4 is supported by a pin 5 on a cover plate 6 so as to be swingable on the pin 5. A cam groove 7 is formed longitudinally in the bottom surface of the cam plate 4. A slot 9 is formed in parallel to the axis of the drum 1 in a front plate 8 fixed to the cam box 2. A traverse guide 10 comprises a slide block 11 slidably mounted on the guide rod 3, a guide arm 13 supported by a pin 12 on the slide block 11 so as to be swingable on the pin 12, a cam shoe 14 rotatably supported by the pin 12 on the slide block 11, a slide piece 15 supported on the guide arm 13, and a yarn guide 16. The guide arm 13 is slidable within the slot 9 of the front plate 8. The cam shoe 14 is fitted in the guide groove A of the drum 1. The slide piece 15 is fitted in the cam groove 7 of the cam plate 4. When the drum 1 is rotated in one direction by a driving source, such as a motor, not shown, the cam shoe 14 is caused to move by the guide groove A, and thereby the traverse guide 10 is reciprocated on the guide rod 3 along the axis of the drum 1. The inclination of the guide arm 13 is dependent on the inclination of the cam groove 7 guiding the slide piece 15. When the cam plate 4 is positioned as illustrated in FIG. 5, the guide arm 13 is in a position 10*a* at the first left returning position L1 or at the second left returning position L2 and is in a position 10*b* at the first right returning position R1 or at the second right returning position R2. There are also shown a yarn Y guided by the yarn guide 16, a bobbin 17 for taking up the yarn Y, and a friction roller 18 adapted to rotate in a direction indicated by an arrow 19 for the contact-driving of a package P.

Figure 6:
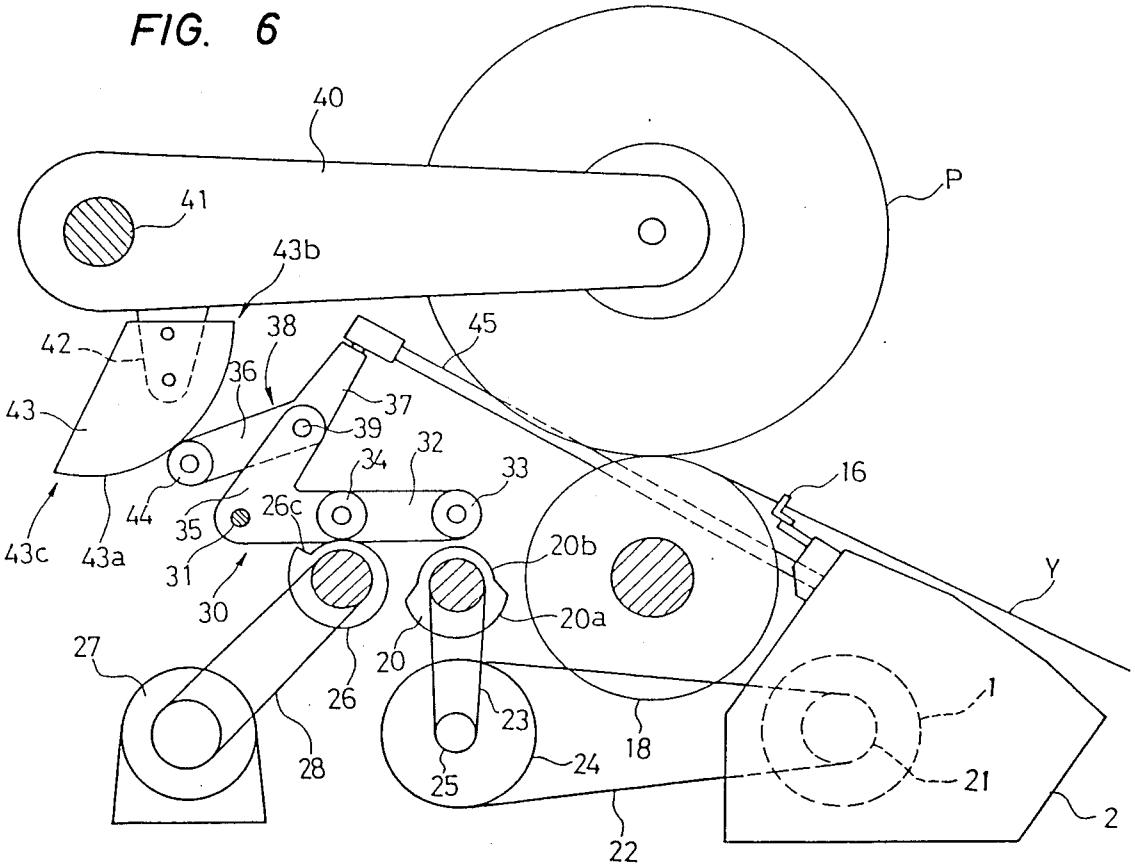
FIG. 6 is a schematic side elevation of a creeping device.

A creeping device is shown in FIGS. 5 and 6. In FIGS. 5 and 6, a synchronizing cam 20 is driven by the drum 1 through a reduction mechanism including a pulley 21 fixed to the shaft of the drum 1, endless belts 22 and 23 and pulleys 24 and 25. A creeping cam 26 is rotated through an endless belt 28 by a pulse motor 27. The reduction ratio of the reduction mechanism associated with the synchronizing cam 20, namely, the ratio of the rotating speed of the synchronizing cam 20 to that of the drum 1, is equal to the reciprocal number of the total wind number m1+m2+m3+m4 of the guide groove A. That is, in this embodiment, since m1=m3=3.75, m2=3.65 and m4=3.85, the reciprocal number of 3.75+3.65+3.75+3.85=15 is 1/15. Thus, fifteen turns of the drum 1 causes the synchronizing cam 20 to turn by one full turn. The synchronizing cam 20 has a cam surface 20*a* having a large radius and extending substantially on a central angle of 180 degrees and a cam surface 20*b* having a small radius and extending substantially on a central angle of 180 degrees. The creeping cam 26 has a cam surface which is so formed to increase the radius proportional to the angle of rotation. The cam 26 is reciprocated, in a certain angle excepting the angle corresponding to the stepped portion 26*c*. The creeping cam 26 is rotated very slowly at a fraction of the rotating speed of the synchronizing cam 20.

A V-shaped swing lever 30 is supported rotatably by a shaft 31 on a frame, not shown. One arm 32 of the swing lever 30 supports cam followers 33 and 34 which engage the cams 20 and 26, respectively, while the other arm 35 supports an interlocking lever 38 having two arms 36 and 37 rotatably by a shaft 39. A cradle 40 supports a package P rotatably at the opposite ends of the same. The cradle 40 is supported so as to be swingable by a shaft 41 on the frame. A plate cam 43 having the shape of one-third of a circle is fixed to a bracket 42 fixed to the base end of the cradle. One arm 36 of the interlocking lever 38 supports a cam follower 44 engaging the cam surface 43*a* of the plate cam 43, while the other arm 37 is connected to the cam plate 4 (FIG. 5) with a connecting rod 45. An extension spring 46 pulls the cam plate 4 and the connecting rod 45 downward, as viewed in FIG. 5, and thereby the cam follower 44 is always kept in contact with the cam surface 43*a* of the plate cam 43 and either the combination of the cam follower 33 and the synchronizing cam 20 or the combination of the cam follower 34 and the creeping cam 26 is kept engaged.

Figure 7:
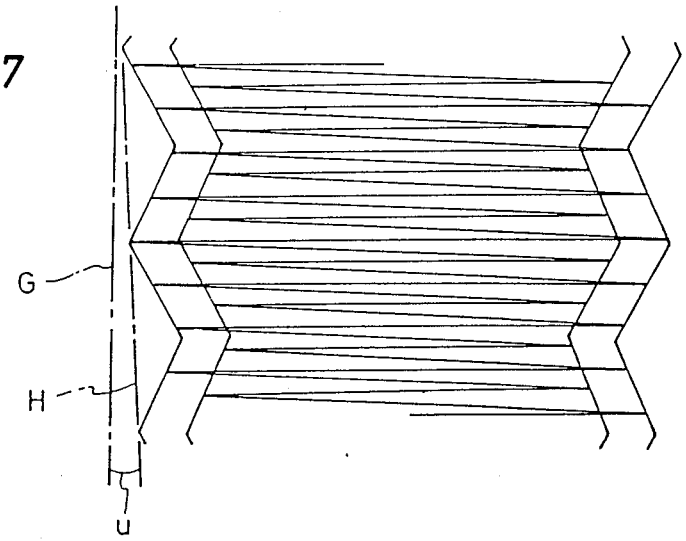
FIG. 7 is a view of assistance in explaining the functions of a creeping cam and a plate cam.

The function of the creeping device will be described first on an assumption that the synchronizing cam 20 and the plate cam 43 are not provided, as a matter of convenience. Upon the start of the yarn winding operation by rotating the drum 1 and the friction roller 18, the motor 27 is actuated to turn the creeping cam 26 alternately in opposite directions. The cam follower 34 is moved upward or downward according to the direction of turning of the creeping cam 26 to cause the swing lever 30 on the shaft 31, and thereby the connecting rod 45, swing the cam plate 4 on the pin 5. Consequently, the inclination of the cam groove 7 varies periodically and the position of the slide piece 15 of the traverse guide 10 relative to the pin 12 at the right and left returning positions varies accordingly. Therefore, the position of the guide arm 13 at the left returning position changes between a position 10*a* indicated by continuous lines and a position 10*c* indicated by alternate long and two short dashes lines in FIG. 5, so that the stroke of traverse is changed periodically as illustrated in FIG. 7.

The function of the plate cam 43 will be described hereinafter. The cam surface 43*a* of the plate cam 43 is formed so that the distance between the center of the shaft 41 of the cradle 40 and the cam surface 43*a* increases from the base end 43*b* toward the nose 43*c* of the cam surface 43*a*. Accordingly, the cam surface 43*a* moves the cam follower 44 downward as the cradle 40 is turned counterclockwise, as viewed in FIG. 6. Consequently, the interlocking lever 38 is turned counterclockwise on the shaft 39 with the increase in the diameter of the package P, and thereby the connecting rod 45 is pulled to reduce the stroke of traverse gradually. As illustrated in FIG. 7, in the locus of the yarn guide thus obtained, the linear locus H of the returning position in the maximum traverse is inclined at a predetermined angle U to a straight line G extending perpendicularly to the axis of the bobbin. The angle U taper the opposite ends of the package P as illustrated in FIG. 5 to prevent the deformation of the shoulders of the package P.

The relation between the synchronizing cam 20 and the creeping cam 26 will be described with reference to FIG. 8 prior to the description of the function of the traverse motion including the synchronizing cam 20. In FIGS. 8*a* to 8*d*, the creeping cam 26 is positioned at the original position, namely, the cam surface 26*b* having a comparatively small radius is positioned opposite to the cam follower 34, while, in FIGS. 8*e* to 8*h*, the creeping cam 26 has been turned through the maximum angle $\theta$ and the cam surface having a comparatively large radius has been positioned opposite to the cam follower 34. As is apparent from FIGS. 8*a* to 8*h*, while the cam surface 26*b* is positioned opposite to the cam follower 34, the cam follower 33 is allowed to be in contact only with the major cam surface 20*a* of the synchronizing cam 20. While the cam follower 33 is in contact with the major cam surface 20*a* of the synchronizing cam 20, the cam follower 34 is separated from the lower cam surface 26*b*. While the minor cam surface 20*b* of the synchronizing cam 20 is positioned opposite to the cam follower 33, the cam follower 34 is allowed to be in contact with the lower cam surface 26*b*, and hence the cam follower 33 is separated from the minor cam surface 20*b* of the synchronizing cam 20. While the higher cam surface 26*a* of the creeping cam 26 is positioned opposite to the cam follower 34, the cam follower 34 is always in contact with the cam surface 26*a*, whereas the cam follower 33 is separated from both the major cam surface 20*a* and the minor cam surface 20*b*. The size of the cams 20 and 26 and the position of the shaft 31 are decided so that the above-mentioned relation between the cams 20 and 26 and the cam followers is established.

In FIGS. 8*a* to 8*d* and in FIGS. 8*e* to 8*h*, the phase of the synchronizing cam 20 is advanced at an angular step of 90 degrees in a clockwise direction. Accordingly, when the angular position of the synchronizing cam 20 is set so that the synchronizing cam 20 is at the phase illustrated in FIGS. 8*a* or 8*e* when the traverse guide 10 is positioned at the first left returning position L1 of the guide groove A of the drum 1, the synchronizing cam 20 is at the phase of FIGS. 8*b* or 8*f* when the traverse guide 10 is positioned at the first right returning position R1; the synchronizing cam 20 is at the phase of FIGS. 8*c* or 8*g* when the traverse guide 10 is positioned at the second left returning position L2; and the synchronizing cam 20 is at the phase of FIGS. 8*d* or 8*h* when the traverse guide 10 is positioned at the second right returning position R2.

Figure 1B:
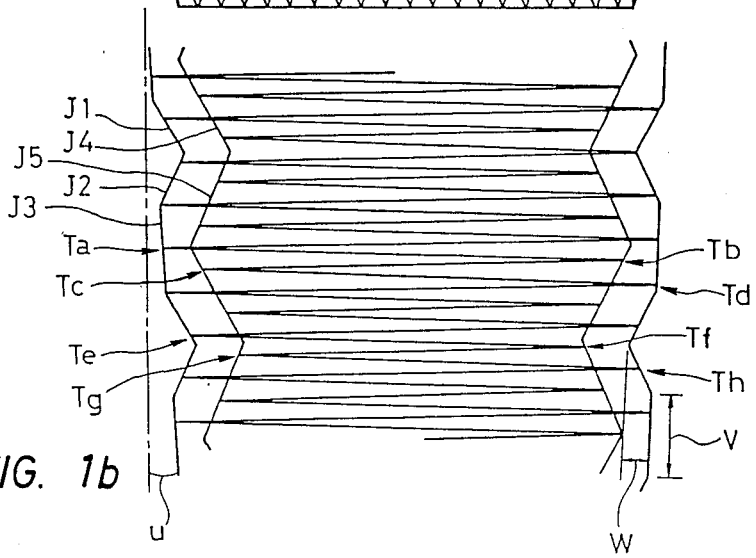
Figure 1C:
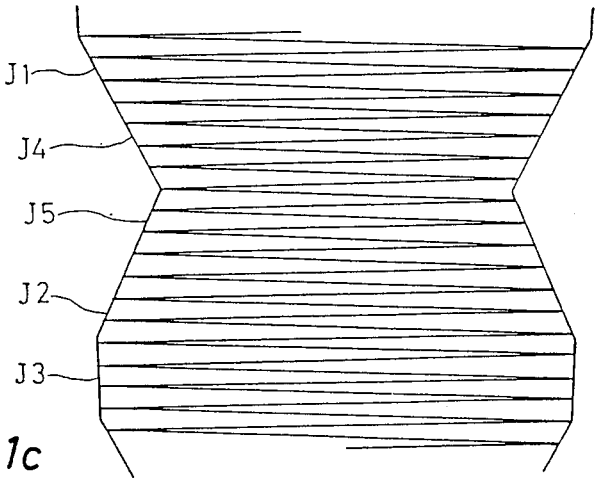

The general function of the creeping device will be described hereinafter with reference to FIGS. 1 and 8 on the basis of the description of the functions of the synchronizing cam 20 and the creeping cam 26 given above. When the traverse guide 10 is positioned at the first left returning position L1, the synchronizing cam 20 and the creeping cam 26 are positioned as shown in FIG. 8*a*. In this state, since the cam follower 33 is in contact with the major cam surface 20*a* of the synchronizing cam 20, the swing lever 30 is disconnected from the creeping cam 26, and hence the creeping action is interrupted temporarily. In this state, the yarn is on the locus Ta of the returning position (FIG. 1*b*). When the traverse guide 10 is positioned at the first right returning position R1, the phase of the synchronizing cam 20 is advanced by an angle of 90 degrees to the position shown in FIG. 8*b* and the cam follower 34 is in contact with the lower cam surface 26*b* of the creeping cam 26. Consequently, the creeping action becomes effective, and thereby the yarn is positioned on the locus Tb of the returning position (FIG. 1*b*). When the traverse guide 10 is positioned at the second left returning position L2, the synchronizing cam 20 is positioned as shown in FIG. 8*c* and the cam follower 34 is still in contact with the lower cam surface 26*b* of the creeping cam 26, and hence the creeping action is continued. Consequently, the yarn is positioned on the locus Tc of the returning position (FIG. 1*b*). As the traverse guide is moved further to the second right returning position R2, the synchronizing cam 20 is positioned as shown in FIG. 8*d* and the cam follower 33 is allowed to be in contact again with the major cam surface 20*a* of the synchronizing cam 20 to interrupt the creeping action. Consequently, the yarn is positioned on the locus Td of the returning position (FIG. 1*b*). While the above-mentioned process is repeated several times, the creeping cam 26 is turned gradually to bring the higher cam surface 26*a* thereof opposite to the cam follower 34. After the higher cam surface 26*a* of the creeping cam 26 has come into contact with the cam follower 34, the cam follower 33 is always separated from the synchronizing cam 20 as illustrated in FIGS. 8*e* to 8*h*. Accordingly, while the higher cam surface 26*a* of the creeping cam 26 is in contact with the cam follower 34, the swing lever 30 is disconnected from the synchronizing cam 20 and is operated only by the creeping cam 26, and hence the creeping action is continued and the returning position of the yarn is on the loci Te, Tf, Tg and Th of FIG. 1*b* corresponding to the phases of the synchronizing cam 20 of FIGS. 8*e*, 8*f*, 8*g* and 8*h*, respectively. Since the creeping cam 26 is turned alternately in opposite directions, the direction of turning of the creeping cam 26 is reversed to turn the creeping cam 26 from the position of FIGS. 8*e* to 8*h* to the position of FIGS. 8*a* to 8*d*. The creeping cam is thus reciprocated periodically. Thus, the traverse of the yarn and the creeping motion are repeated periodically to wind the yarn in the pattern illustrated in FIG. 1*b*. The loci of the returning position developed by the agency of the creeping motion shown in FIG. 1*b* is divided into segments J1 to J5 in the same manner as described hereinbefore with reference to FIGs. 14*b* and 14*c* and the segments are rearranged in the order of J1, J4, J5 J2 and J3 as shown in FIG. 1*c*. As apparent from FIG. 1*c*, the returning positions overlap each other only at the edges of the package. Accordingly, the package P thus formed has a satisfactory shape without any protuberant edge as shown in FIG. 1*a* and ribonning is prevented. A period V (FIG. 1*b*) in which the yarn is traversed over the maximum stroke of traverse corresponds to a period in which the cam follower 34 is separated from the higher cam surface 26*a* of the creeping cam 26 during the one cycle of reciprocation of the creeping cam 26. Accordingly, the creeping ratio and the creeping width W can be optionally decided by selectively deciding the shape and the angle $\theta$ of reciprocation of the creeping cam.

Figure 9:
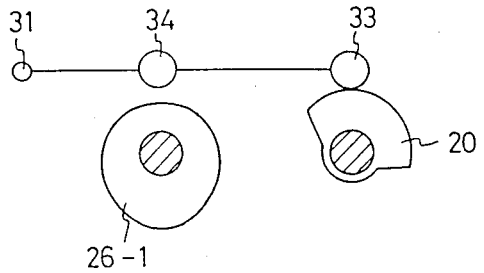
FIG. 9 is a schematic view of another embodiment of the present invention.

FIG. 9 shows another embodiment of the creeping device employing a creeping cam 26 having a symmetric substantially oval shape instead of the creeping cam 26. This creeping cam 26-1 is rotated continuously in one direction for the same effect as that of the creeping cam 26.

Figure 10:
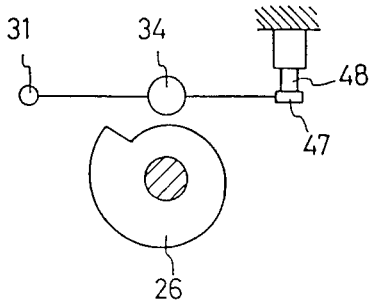
FIG. 10 is a schematic view of a further embodiment of the present invention.

FIG. 10 shows a further embodiment of the creeping device. In this embodiment, an iron piece 47 fixed to the free end of the swing lever and an electromagnet 48 disposed opposite to the iron piece and adapted to be controlled by a control circuit, not shown, are provided instead of the cam follower 33 and the synchronizing cam 20. The electromagent 48 is energized only during a period corresponding to the period of phases shown in FIGS. 8*a* to 8*d* to attract the iron piece 47 so that the cam follower 34 is separated from the creeping cam 26. The effect of this embodiment is the same as that of the first embodiment.

According to the present invention, the right returning position and the left returning position of the yarn are varied alternately between different positions, and thereby ribboning is prevented. Furthermore, since the creeping action is varied for each returning position, the edge rising is eliminated and a package having a desired shape can be formed by appropriately setting creeping motion.

What is claimed is:

1. A method of winding a yarn on a bobbin to form a generally cylindrical package comprising the steps of:

(a) traversing a yarn with a yarn guide longitudinally in the direction of the axis of the package from a right returning position at one end of the package to a left returning position at the other end of the package, (b) alternately varying the right returning position and the left returning position during the winding operation in a creeping motion, (c) interrupting the creeping motion periodically in the winding operation, and (d) reinstating the creeping motion after each interruption wherein the creeping motion is altered in respect to the axis of the package when resumed after interruption.

2. A method as defined in claim 1 which includes the step of traversing the yarn guide with a spiral drum having different and spaced guide grooves with differently axially oriented progressing and returning grooves.

3. A method of winding a yarn as defined in claim 1 wherein the creeping motion comprises the step of increasing a stroke of traverse and of decreasing the stroke of traverse at the right returning position alternately repeated, and the step of increasing a stroke of traverse and of decreasing stroke of traverse at the left returning position alternately repeated in order.

4. A yarn winding apparatus to form a generally cylindrical package having a central axis of rotation with a right returning position at one end of the package and a left returning position at the other end of the package comprising:

(a) a spiral drum having a plurality of different and spaced guide grooves consisting of differently spaced progressing grooves and returning grooves, (b) a traverse guide member for traversing a yarn along the guide grooves in a reciprocating motion along the axis of the package, (c) a first creeping cam means operatively connected to the guide member for imparting a creeping motion to the guide member to selectively vary the right and left returning position of the guide member, and (d) means to disconnect the first cam means and the traverse guide member temporarily to shift the creeping motion of the guide member relative to the axis of the package upon resumption of the connection of the first cam means and the guide member.

5. A yarn winding device as defined in claim 4 which includes a guide rod mounted essentially parallel to the axis of said drum, said traverse guide member comprising a slide block slidably mounted on said guide rod, a guide arm carrying the yarn guide swingably mounted on said slide block, a cam plate pivotally mounted adjacent said guide rod having a cam groove extending along said guide rod, and a slide piece on said guide arm slidable in said cam groove wherein the inclination of said guide arm relative to said package is governed by the position of said cam plate.

6. A yarn winding device as defined in claim 5 in which said cam plate is operatively connected to said first creeping cam wherein said creeping cam controls the position of said cam plate and the inclination of said guide arm.

7. A yarn winding device as defined in claim 6 in which said creeping cam includes a cam follower normally in contact with said creeping cam, and said means to disconnect said creeping cam comprises a secondary cam movable to move said cam follower away from said creeping cam for a predetermined time to interrupt said creeping motion.

8. A yarn winding device as defined in claim 4 in which a means for reducing the reciprocation of the yarn guide is provided responsive to the increase in diameter of the package to taper the ends of the package from the inner diameter to the outer diameter.

9. A yarn guide as defined in claim 7 in which a third cam means movable in response to the increase in diameter of the package is operably connected to said cam plate to gradually shift the inclination of said guide arm from an outer extreme position to a predetermined inner position to impart a taper to the ends of the package.

10. A yarn guide as defined in claim 7 in which a third cam means movable in response to the increase in diameter of the package is operatively connected to said cam follower to alter the inclination of said guide arm as the winding diameter increases.

11. A yarn guide as defined in claim 6 in which said creeping cam includes a cam follower normally in contact with said creeping cam, and said means to disconnect the first cam means and traverse guide means comprises a solenoid acting selectively on said cam follower to separate the cam follower from said creeping cam.

* * * * *

UNITED STATES PATENT AND TRADEMARK OFFICE

CERTIFICATE OF CORRECTION

PATENT NO. : 4,767,071

DATED : August 30, 1988

INVENTOR(S) : Kazuyasu Hirai

It is certified that error appears in the above-identified patent and that said Letters Patent are hereby corrected as shown below:

Column 10, Line 8, change "claim 7" to - claim 5 -.

Signed and Sealed this

Twenty-fourth Day of January, 1989

*Attest:*

DONALD J. QUIGG

*Attesting Officer*

*Commissioner of Patents and Trademarks*